US007895926B2

(12) United States Patent
May, II et al.

(10) Patent No.: US 7,895,926 B2
(45) Date of Patent: Mar. 1, 2011

(54) DIE CUTTING UNDER VACUUM THROUGH ROLLERS

(75) Inventors: James L. May, II, Fort Gratiot, MI (US); David Arthur Hunwick, St. Clair, MI (US)

(73) Assignee: Ontario Die International Inc., Kitchener (CA)

( * ) Notice: Subject to any disclaimer, the term of this patent is extended or adjusted under 35 U.S.C. 154(b) by 573 days.

(21) Appl. No.: 11/491,885

(22) Filed: Jul. 24, 2006

(65) Prior Publication Data

US 2007/0039436 A1 Feb. 22, 2007

Related U.S. Application Data

(60) Provisional application No. 60/701,995, filed on Jul. 25, 2005.

(30) Foreign Application Priority Data

Jul. 25, 2005 (CA) ..... 2513158

(51) Int. Cl.
*B26F 1/42* (2006.01)
*B26F 1/38* (2006.01)

(52) U.S. Cl. ..... 83/19; 83/29; 83/567; 83/569

(58) Field of Classification Search ..... 83/566, 83/936, 939, 531–533, 540, 541, 19, 29, 83/567–569, 639.1, 639.3
See application file for complete search history.

(56) References Cited

U.S. PATENT DOCUMENTS

| | | | | |
|---|---|---|---|---|
| 3,237,499 | A * | 3/1966 | Lohrand et al. | 83/510 |
| 3,529,506 | A * | 9/1970 | Rune et al. | 83/698.71 |
| 3,616,720 | A * | 11/1971 | Larson | 83/691 |
| 4,638,731 | A * | 1/1987 | Kato | 100/282 |
| 4,672,870 | A | 6/1987 | Levene et al. | |
| 4,694,719 | A | 9/1987 | Levene et al. | |
| 4,860,622 | A * | 8/1989 | Di Bernardo | 83/285 |
| 4,960,019 | A | 10/1990 | Levene et al. | |
| 5,647,260 | A * | 7/1997 | Nabity | 83/522.12 |
| 5,778,748 | A * | 7/1998 | Beijen | 83/529 |
| 6,220,136 | B1 * | 4/2001 | Benes et al. | 83/566 |
| 6,233,809 | B1 | 5/2001 | Geffros et al. | |
| 2002/0152868 | A1 * | 10/2002 | Benes et al. | 83/531 |
| 2004/0211303 | A1 * | 10/2004 | Horning et al. | 83/13 |

* cited by examiner

*Primary Examiner* — Laura M. Lee
(74) *Attorney, Agent, or Firm* — Woods Oviatt Gilman LLP

(57) ABSTRACT

In a process and apparatus for cutting a sheet material, one or more sheets of the material are placed over a die attached to a die board. A cutting pad is placed over the sheet material. Seals are placed around or between the die board and cutting pad to create an enclosure. A vacuum is created in the enclosure or between the die board and cutting pad so as to draw the die board and cutting pad together and compress the sheets of material. The resulting assembly is passed through a roller press to cut the sheets of material. A process or apparatus for mounting dies to a die board or stripping scrap from between dies and a quick release fastener are also described.

4 Claims, 5 Drawing Sheets

DIE CUTTING UNDER VACUUM THROUGH ROLLERS

This application claims the benefit under 35 USC 119(e) of U.S. Application Ser. No. 60/701,995 filed Jul. 25, 2005 and claims priority to Canadian Application Serial No. 2,513,158 filed Jul. 25, 2005. U.S. Application Ser. No. 60/701,995 and Canadian Application Serial No. 2,513,158 are incorporated herein, in their entirety, by this reference to them.

FIELD

This specification describes one or more inventions that may relate to one or more of die cutting, steel rule or cavity dies, vacuum pre-compression in die cutting and roller presses.

BACKGROUND

The following background description is not an admission that any apparatus or method discussed below is prior art or part of the knowledge of people skilled in the art in any country.

U.S. Pat. No. 4,960,019 describes a stationary steel rule cutting die for cutting a fixed pattern in each of a plurality of stacked compressible material layers according to the shape of the steel rule die and including a vacuum system for reducing the stacked height of the compressible material layers prior to cutting. The die assembly includes an enclosure comprising an upper wall and collapsible side walls extending downwardly from the upper wall. A rigid annular structure is secured to the lower edge of the collapsible side walls. The enclosure is positioned over the stacked compressible material layers with an annular sealing surface defined on the lower peripheral edges of the rigid annular structure coacting with an upwardly facing, closed loop sealing surface defined on the steel rule cutting die to define a sealed chamber from which air is exhausted through the rigid annular structure to collapse the side walls of the enclosure and compress the material layers prior to cutting.

In U.S. Pat. No. 6,233,809, a cutting knife assembly has a baseboard with a generally planar surface. A cutting knife is detachably connected to the baseboard. The cutting knife extends in a perpendicular direction to the baseboard. The cutting knife circumscribes a knife cavity on the baseboard. At least one elongated cross member is affixed to the cutting knife and extends across the knife cavity. The cross member is mounted to the baseboard by a removable fastener. The cutting knife may then be easily removed from the baseboard and resecured.

U.S. Pat. Nos. 4,960,019 and 6,233,809 are incorporated herein, in their entirety, by this reference to them.

SUMMARY

It is an object of an invention described herein to improve on, or at least provide a useful alternative to, the prior art. It is another object of an invention described herein to provide a process or apparatus for cutting a material. The following summary is intended to introduce the reader to one or more of the inventions but not to define any invention. An invention may reside in any combination of one or more apparatus elements or process steps selected from the set of all apparatus elements and process steps described in any part of this document.

The inventors have observed that there is a need for a cost efficient method and apparatus for cutting low to medium quantities of material with high accuracy and material utilization, for example to produce automotive upholstery pieces for small manufacturers or limited production vehicles. Low to medium quantities may be, for example, the parts required in one material, for example cloth fabric or a vinyl laminate, for the interior of 1 to 20 automobiles. Some low volume work is being performed on machines that have some form of a computer controlled cutting head moving over a stationary sheet of material on a table. While these machines may be cost effective, the quality of the cut pieces is not as good as what may be obtained with dies. Some leather cutting is done by a roller press process. In this type of process, a sheet of leather is placed on a cutting pad which is a board made of a material, such as polypropylene, which is rigid enough to create a surface which can be cut against but soft enough to allow edges of the knives of dies to penetrate into it. Die cavities are placed on the leather by workers trained to get a good quantity and quality of cut pieces from irregularly shaped leather stock. This assembly is then sent through a roller press to cut the leather. While the cost of the roller press is sufficiently low for use in leather cutting, the process is not cost effective for cloth or vinyl work because the rate of production is comparatively low when compared to rates of production for cloth or vinyl cutting. Achieving higher throughput would require placing more layers of material under the dies with each pass. However, particularly with multiple layers of material, the rollers move or stretch the material as it is being cut causing the parts to grow in one direction or generally be inaccurately cut.

High volume automotive interiors are generally cut using steel rule type dies, cutting many layers of materials simultaneously in large presses. This process provides high quality parts, but the cost of a large press can only be recovered in high volume situations.

A process or apparatus described herein deals with these issues, in brief, by using a vacuum to compress multiple sheets of material against a set of dies before or while passing the material and dies through a roller press. The vacuum makes the die and material assembly more stable as it passes through the rollers and allows multiple layers to be cut accurately. Stability of the die and material assembly may be further enhanced by making the dies from narrow knife stock to create a low die and further optionally by installing braces vertically in some locations. Output may be further enhanced by placing the dies very close together or touching each other which is facilitated by using offset bevel steel for the knives of the die and removably mounting one or more dies to a die board which also aids in removing scrap pieces. Further optionally, in places where dies touch each other, parts of the outside side walls of the adjacent cavities may be ground to or near the point of the knife. Further optionally, the material and dies may be further pre-compressed by passing them through the roller press with the rollers set to a compressing, rather than cutting, separation distance. The process or apparatus thus provides a way to economically cut low to medium volumes of material accurately and economically or other uses or benefits, particularly where the same roller press can also be used part time for leather cutting.

In one aspect, an apparatus has a plurality of cavity dies attached to a die board. The dies and die board may be installed into, or be part of, an enclosure. The enclosure has or contains a cutting pad on the opposite side of the dies from the die board. The enclosure also has collapsible side walls and room for sheets of material, for example 1 to 6 sheets of material, to be placed in the enclosure between the dies and the cutting pad. A vacuum system can be attached in communication with the interior of the enclosure to create a vacuum in the enclosure, thus drawing the cutting pad and die board together and compressing any material between the dies and the cutting pad. The enclosure may be fed through a roller press to press the cutting pad against the dies so as to cut the material. One or more of the dies may have a brace or base plate through which it is attached to the baseboard. The dies may have offset bevel steel knives made of knife stock having a width of 32 mm or less or 20 mm or less, such that the die is 32 mm or less or 20 mm or less tall. One or more of the dies may be attached to the baseboard with quick release fasteners. The dies may be spaced from 0-1 mm apart from each other.

In another aspect, a process is described for producing pieces of material cut to a pattern from one or more, for example 1 to 6, sheets of material using cutting dies. The cutting dies are mounted on a die board in a pattern fitting within the perimeter of the sheets of material. The dies may touch adjacent dies or be spaced apart by 1 mm or less from adjacent dies at least along the controlling length or width of a nest or marker of dies. Sheets of material are placed on the dies. A cutting pad is placed over the sheets of material. The cutting pad is forced towards the die board, for example by a vacuum, to compress the sheets of material against the dies. The die board, dies, sheets of material and cutting pad are then passed through a roller press which forces the cutting pad into contact against the dies to cut the sheets of material. Optionally, one or more of the dies may be removed from the die board after cutting to assist in removing scraps of material from between adjacent dies. Further optionally, the sheets of material may be passed through the roller press to further pre-compress the material before cutting.

In other aspects, a quick release fastener, a die assembly with releasable dies and processes for mounting or removing dies or removing scrap from between dies are disclosed.

BRIEF DESCRIPTION OF THE FIGURES

One or more embodiments of one or more inventions will be described below with reference to the following figures.

DETAILED DESCRIPTION

Various apparatuses or processes will be described below to provide an example of an embodiment of each claimed invention. No embodiment described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention. The applicants, inventors and owners reserve all rights in any invention disclosed in an apparatus or process described below that is not claimed in this document and do not abandon, disclaim or dedicate to the public any such invention by its disclosure in this document.

Figure 1:
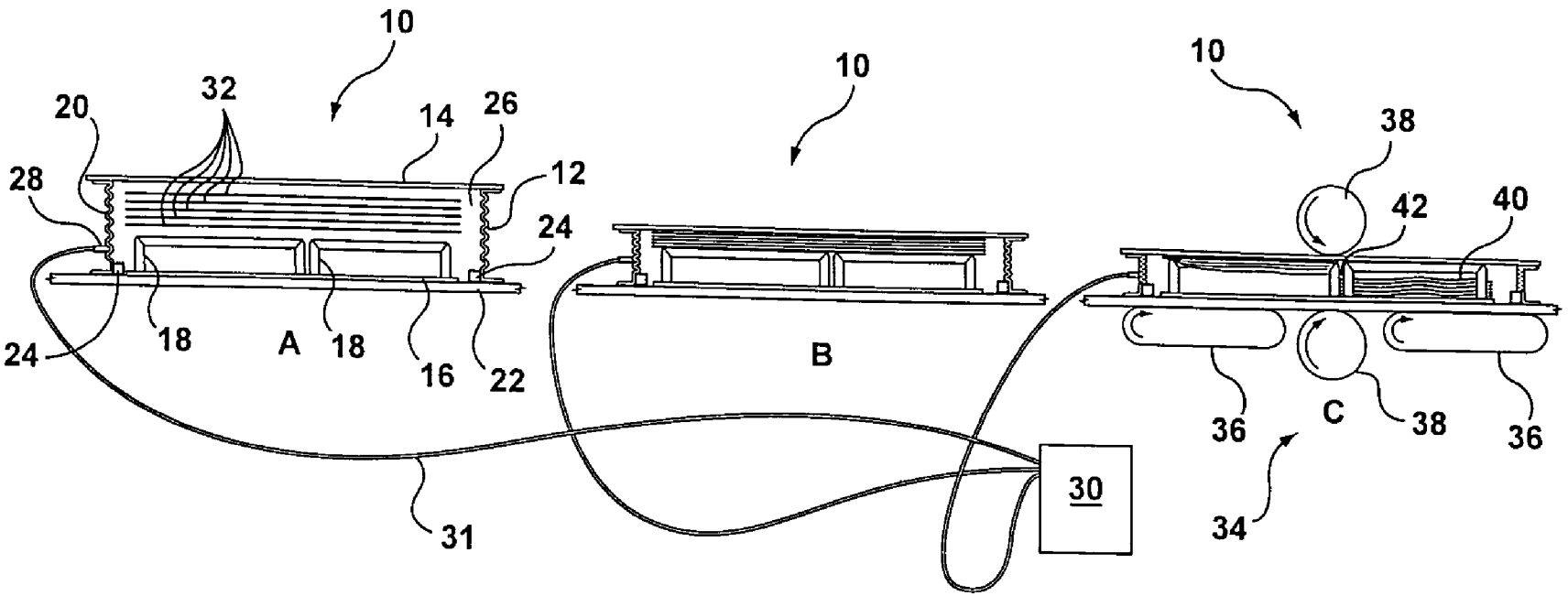
FIG. 1 is a schematic representation of a die cutting apparatus being used to cut sheets of material.

Referring to part A of FIG. 1, a cutting assembly 10 has an enclosure 12, a cutting pad 14, a die board 16 and dies 18. Dies 18 may be attached to the die board 16 by braces and fasteners as in U.S. Pat. No. 6,233,809. Optionally, dies 18 may be attached to die board 16 by making slots in the die board 16 to accept the dies 18. When using slots in the die board 16, the dies 18 may need to be spaced according to the limitations of router or laser slot cutting whereas using braces and fasteners to mount the dies 18 may allow for a closer spacing. In the embodiment illustrated, enclosure 12 incorporates cutting pad 14 and also has collapsible sides 20, a bottom plate 22 and seals 24.

Cutting pad 14 is made of a material, such as polypropylene, which is rigid enough to create a surface which may be cut against but soft enough to allow the dies 18 to penetrate it slightly. Die board 16 may be of any material, for example high density plastic, wood, or steel, suitable for transferring pressure from a press to the dies 18. Optionally, cutting pad 14 may comprise two pads placed against each other in parallel. An outer pad is not penetrated by the dies 18 and so ensures that a seal or vacuum can be maintained. An inner pad is affixed to the underside of the outer pad, for example by adhesive tape or threaded fasteners. After many cuts, the inner pad may become eroded and need to be replaced. At such time, the inner pad is removed from the outer pad and replaced by a new inner pad.

Sides 20 may be of a rubber covered fabric or other flexible but generally gas impermeable material. Base plate 22 may be steel. Seals 24 may be fastened or bonded to sides 20 and attach to base plate 22, for example magnetically, to enclose and seal a plenum 26 including space between the press board 14 and the die board 16. An outlet 28 through a side 20 allows the plenum 26 to be connected to a vacuum source 30, for example a vacuum pump, through hose 31. Vacuum pump 30 is operable to create a partial vacuum in plenum 26 causing enclosure 12 to partially collapse and move press board 14 and die board 16 together to compress sheets of material 32 against dies 18 as shown in part B of FIG. 1. Cutting assembly 10 may then be fed through a roller press 34 as shown in part C of FIG. 1. Roller press 34 has conveyors 36 which force cutting assembly 10 through a pair of rollers 38. Rollers 38 press the press board 14 against the die board 16 such that press board 14 is made to contact the tops, or knife edges, or dies 18. The sheets of material 32 are cut by the dies 18. Cut pieces 40 of material, shaped according to the patterns embodied by dies 18, fall into the cavities of dies 18. Scrap pieces 42 fall into spaces between dies 18. The spaces within or between dies 18 may optionally have a layer of foam (not illustrated) placed in them as described in U.S. Pat. No. 4,960,019.

Optionally, assembly 10 can be passed through the roller press 34 in multiple passes to either further pre-compress the sheets of material 32 or to cut the sheets of material 32 in multiple passes. For example, during a first pass in a first direction, the rollers 38 may be set at a separation distance that further compresses the sheets of material 32 but does not cut them. The vacuum pump 30 may be on during this first pass such that there is only a limited rebound of the sheets of material 32 after the first pass, if any. The rollers 38 may then be moved closer together and the assembly passed through the rollers 38 a second time, optionally in a reverse direction. This second pass may cut the sheets of material 32. For example, 6 plies of a fabric material might initially have a thickness of 35 to 40 mm when placed on the dies 18. When the assembly 10 is assembled and vacuum source 30 turned on, the sheets of material 32 may compress, depending on the material, to for example 12 to 35 mm. A first pass through the roller press 34 with roller 38 set at a separation distance, less than the height of the assembly 10 but large enough to not cut the sheets of material 32, may result in the sheets of material 32 having a thickness of 80 percent or less, or 60 percent or less, of their thickness before this pass, that is their thickness under vacuum alone. Stacks of a lesser number of sheets of material 32 involve correspondingly lesser thicknesses. The vacuum source may be left on continuously from before the first pass through roller press 34, whether it is a cutting or compressing pass, until the sheets of material 32 have been fully cut.

Figure 2:
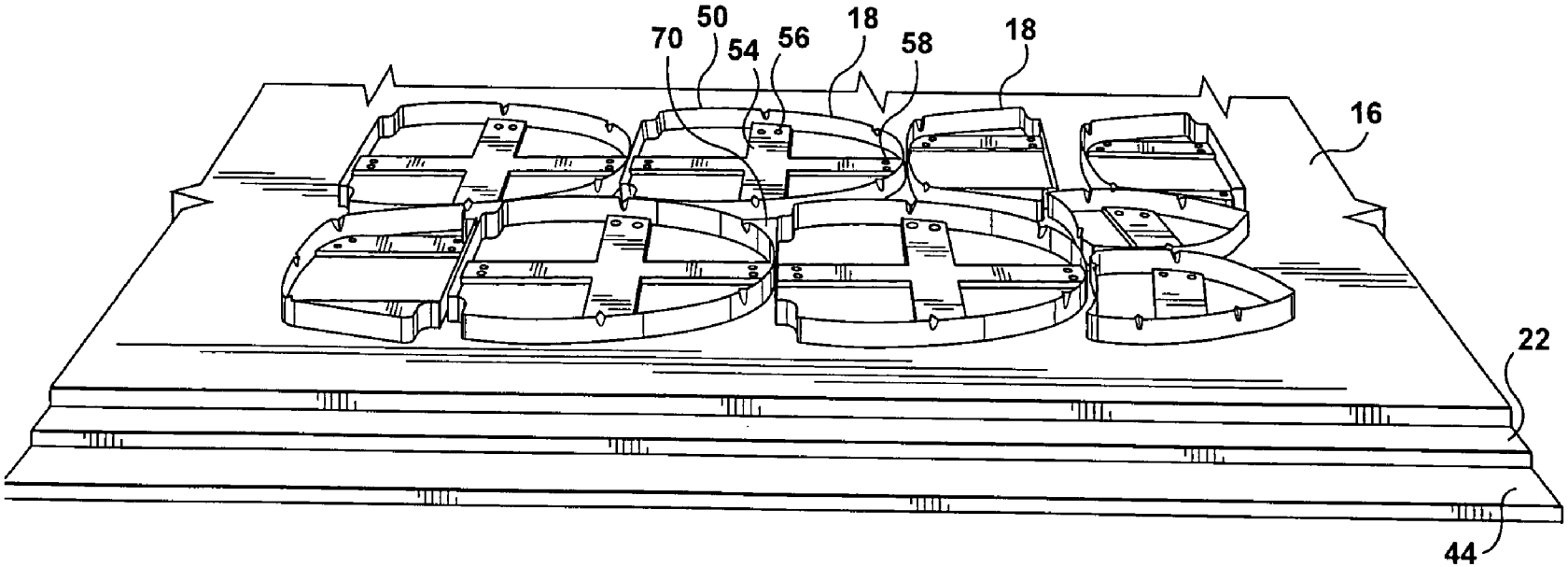
FIG. 2 is a perspective view of several dies fastened to a die board resting on the bottom of an enclosure according to the apparatus of FIG. 1.

FIG. 2 shows base plate 22 resting on a sheet of high density plastic 44 used to facilitate moving cutting unit 10 along skid tracks towards a roller press 34. Die board 16 may be about 1-3 meter in width and 2-7 meters in length and have dies 18 across almost its entire area. A paper pattern (not shown) may be placed on die board 16 to aid in placing dies 18 according to a computer generated plot, printed on the paper pattern, of a best fit for dies 18 to minimize the amount of scrap produced from a piece of material of a given size. Dies 18 illustrated are removable dies attached to the die board 16 by fasteners through braces 54, as described in U.S. Pat. No. 6,233,809 although other types of die 18 and die board 16 assemblies may be used.

Figures 3, 3A:
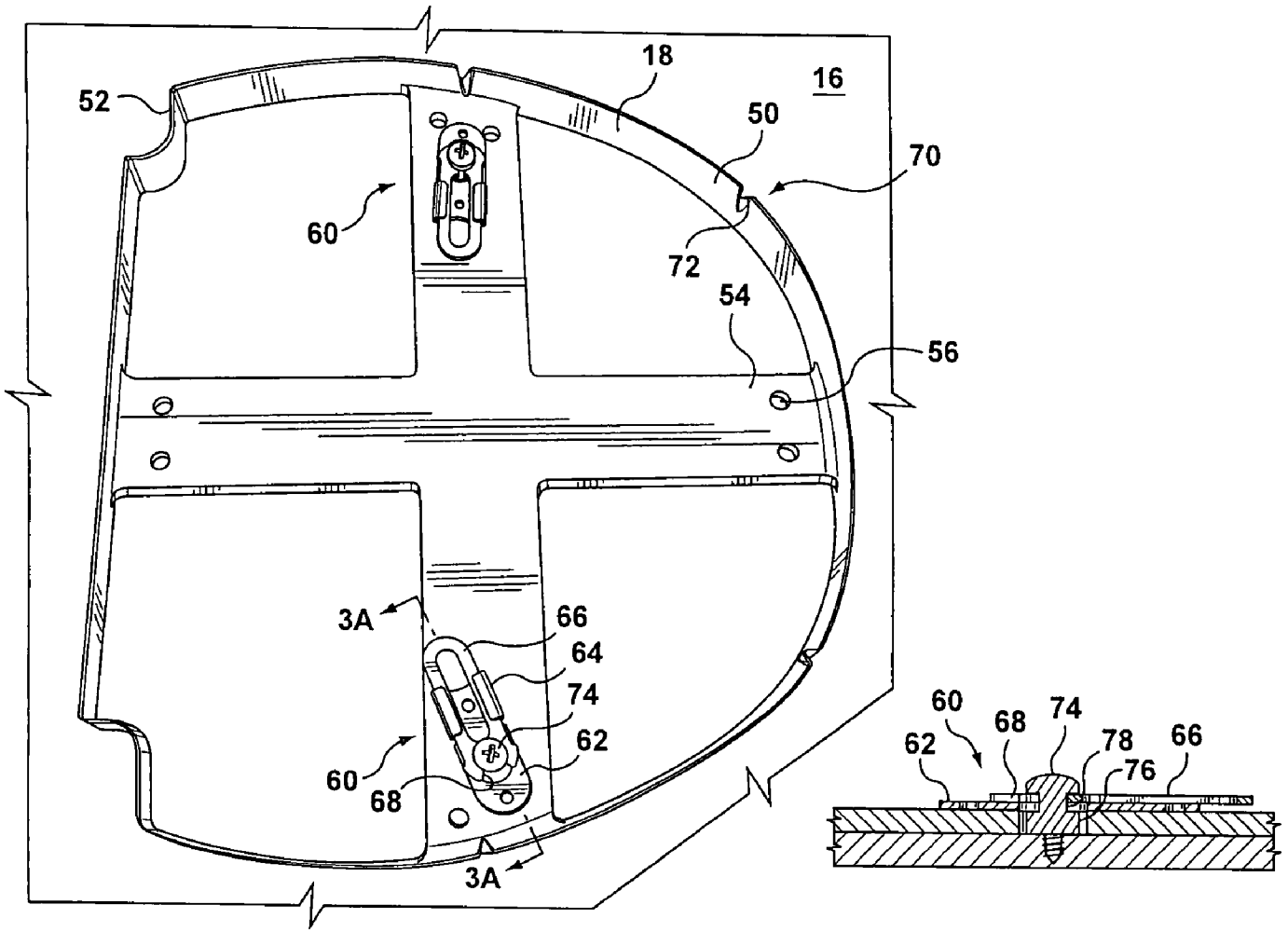
FIG. 3 is a perspective view of a section of a die board with a die fastened to the die board with a quick release fastener.
FIG. 3A is a section view through a part of the die, die board and quick release fastener of FIG. 3.
Figure 4:
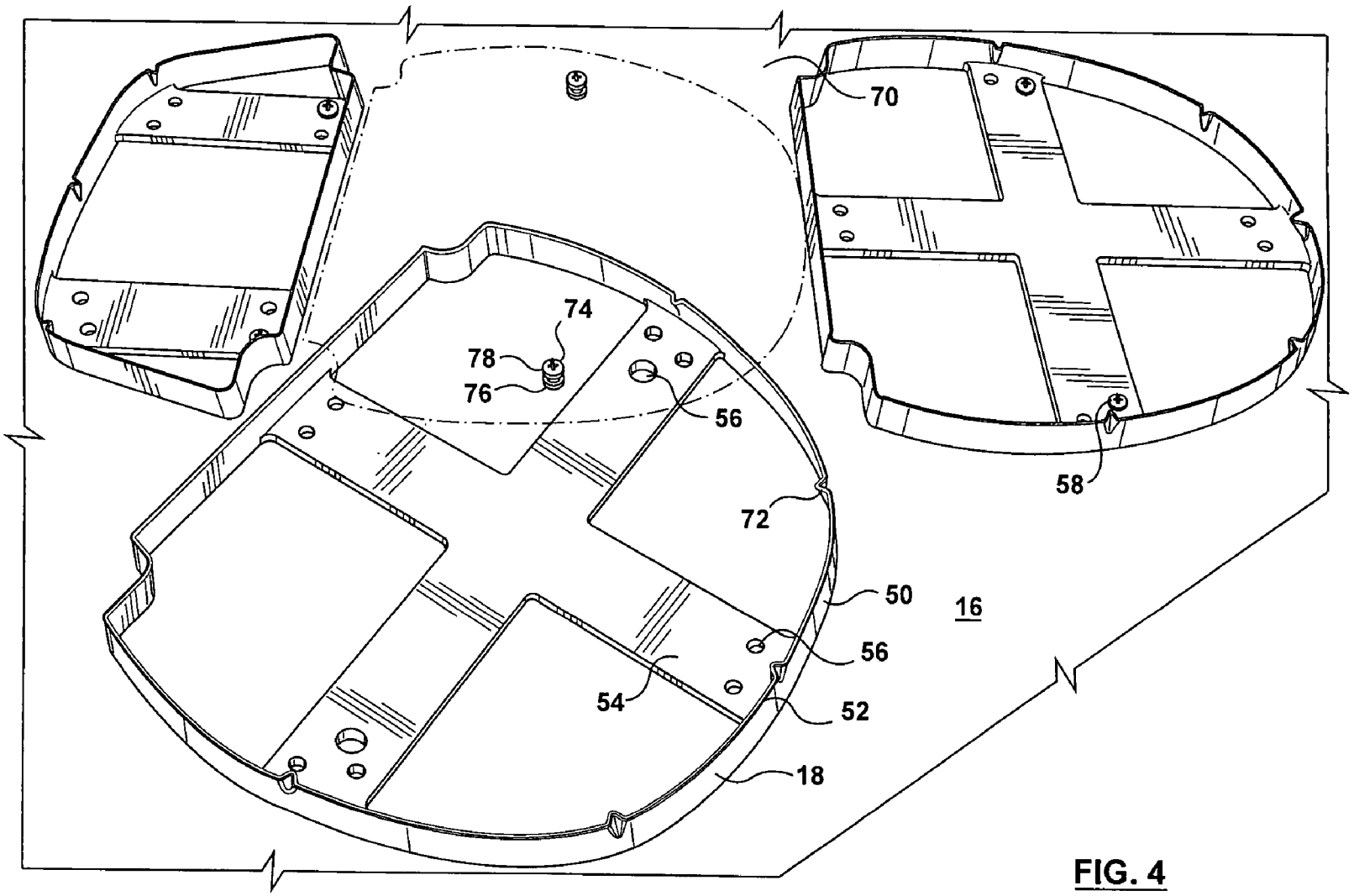
FIG. 4 is an enlarged perspective view of a portion of the dies and die board of FIG. 2 with a die removed to assist in removing scraps of cut material.

FIGS. 3 and 4 show some dies 18 in larger detail. Dies 18 have a knife 50 having a knife edge 52 defining the shape of the periphery, or pattern, of a piece of material to be cut with the die 18. The knife 50 is supported by braces 54 which also have holes 56 to facilitate using fasteners, for example screws 58, to attach the dies 18 to die board 16. Braces 54 are shown oriented horizontally although some braces 54 may optionally be made of a narrower material, oriented vertically, and located to strengthen areas of a die 18 under significant stress, for example where adjacent dies 18 touch each other or are very close together.

One or more dies 18 may also be fastened to die board 16 with quick release fittings 60. As shown in FIGS. 3, 3A and 4, quick release fitting 60 has cooperating elements or screws 74 that may be threaded into the die board 16 and cooperate with a bottom plate 62 and top plate 66. Cooperating screws 74 have a shaft having a wide portion 76 which is the same diameter as the head of cooperating screw 74 and fits into an enlarged hole in brace 54 for example with an interference fit. The shaft also has a narrow section 78 between the head and the wide portion 76 of the shaft. Bottom plate 62 has a hole sized to fit over the head of cooperating screw 74 and guides 64 which hold the top plate 66 against the bottom plate 62 but allow the top plate 66 to slide horizontally. Top plate 66 has a slot 68 which is adapted to fit around narrow section 78 but not allow the head of a cooperating screw 74 to pass through the slot 68. Slot 68 may also have a narrow opening such that top plate 66 snaps around the cooperating screw 74. With top plate 66 slid so that the narrow section 78 of cooperating screw 74 is within slot 68, the head of cooperating screw 74 can not pass through fitting 60 and so brace 54 is held in place. However, with top plate 66 slid away from cooperating screw 74, the head of cooperating screw 74 can pass through fitting 60 allowing brace 54 and fitting 60 to be removed. Although this method and apparatus of mounting dies is described herein in combination with a roller press 34, the same apparatus or process may be used to fasten dies 18 to die board 16 for use in other kinds of presses.

The knife 50 of die 18 may be relatively short compared to dies used in other applications. For example, knife 50 may be 32 mm tall or less or 20 mm tall or less, for example about 19 or 20 mm. The inventors have found that taller knives 50 are not necessary for economical low to medium volume cutting and may flex and so produce less accurate cut pieces in the method and apparatus of the invention. Knife edge 52 is offset to the outside of dies 18. With this offset, and the short knife 50 being used to cut a limited, for example 6 or less, number of sheets, dies 18 can be placed very close together, for example at spacings of 1 mm or less or even touching at points of tangency with neighbouring dies 18. Such small spacing may be required only between those dies 18 located along the controlling length or width of a set of dies 18. Where die 18 spacing can be increased without increasing the length or width of a set of dies, a larger spacing may be used to reduce stress on the dies 18 and make scrap removal easier. Optionally, in places where adjacent dies 18 touch each other, the outside of the dies 18 may be ground down or otherwise removed to, or near to, knife edge 52 to reduce or remove the bevel on the outside of knife edge 52. This allows parts of two adjacent dies 18 to be placed next to each other so as to create, in effect, a section of thick blade with a knife edge 52 in its center serving two adjacent dies 18.

The small spacing along the controlling width or length, even compared to a slightly larger 3 mm spacing, produces a great reduction in scrap wastage. However, scrap pieces may be forced tightly into small inter die areas 70, particularly if marker notches 72 in knife 50 angle into an inter die area 70. Removing scrap from these areas is facilitated by attaching one or more dies 18 with the quick release fittings 60. The quick release fittings 60 allow these dies 18 to be quickly removed between cuts, as shown in FIG. 4, to strip scrap from the inter die area 70. Since not all dies 18 will have very small inter die areas 70 near them, and since removing one die 18 opens up the inter die spaces that the removed die 18 shares with stationary dies 18, only some dies 18 need to be fitted with quick release fittings 60 or removed between cuts. Other dies 18 may be simply screwed to die board 16 and remain in place between cuts.

Figure 5:
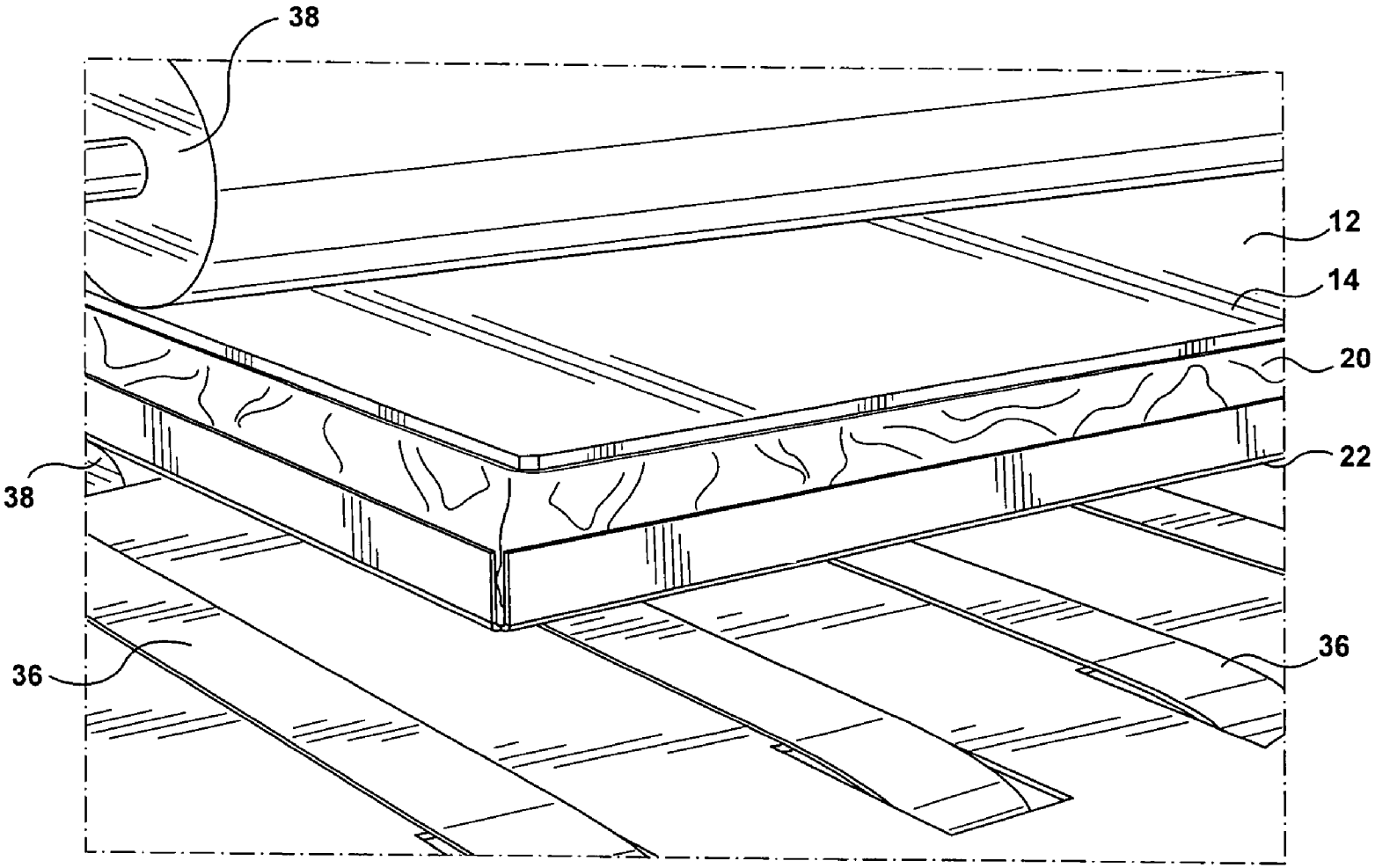
FIG. 5 is a perspective view of an enclosure containing dies according to FIGS. 1 and 2 being fed through a roller press.

As shown in FIG. 5, a top part of the enclosure 12 including cutting pad 14 and sides 20 has been attached over base plate 22. Seals 24 are within sides 20 and not visible. Die board 16, dies 18 and a sheet of material placed over the dies 18 are not visible but located within enclosure 12. A vacuum source 30, not visible, is applying a partial vacuum to enclosure 12. The resulting cutting unit 10 is being moved by conveyors 36 to the rollers 38 of a roller press 34. Cutting unit 10 will emerge from the other side of roller press 34 with the sheet of material having been cut by the dies 18.

The description above was of a sample embodiment or embodiments of one or more claims and not intended to limit or define the invention of any claim which may be carried out in various alternate embodiments.

We claim:

1. A method for cutting a plurality of sheets of material, comprising:

a) providing a die board having at least one die thereon;

b) providing a cutting pad on the other side of the at least one die from the die board, with the plurality of sheets of material provided between the cutting pad and the at least one die;

c) providing an enclosure that surrounds the at least one die, the die board, the plurality of sheets of material, and the cutting pad;

d) creating a vacuum in the enclosure so as to draw the die board and cutting pad together to compress the plurality of sheets of material;

e) after step (d), passing the enclosure through a roller press in a first pass so that the enclosure is brought into contact with a pair of opposing rollers positioned at a compressing position wherein the distance between the rollers is selected so as to further compress the plurality of sheets of material during the first pass; and f) after step (e), passing the enclosure through the roller press in a second pass with the pair of rollers positioned at a cutting position wherein the distance between the rollers is selected so as to cut the plurality of sheets of material during the second pass.

2. The method of claim 1, wherein the vacuum is maintained in the enclosure during steps (e) and (f).

3. The method of claim 1, wherein step (a) further comprises attaching the at least one die to the die board using a quick release fastener.

4. The method of claim 3 wherein a plurality of dies are attached to the die board and, after step (f), a die previously attached to the die board by a quick release fastener is removed and scrap material is stripped from an inter-die space.

* * * * *